United States Patent [19]

Mishkovsky et al.

[11] Patent Number: 4,762,542

[45] Date of Patent: Aug. 9, 1988

[54] PROCESS FOR THE RECOVERY OF ARGON

[75] Inventors: Vladimir Mishkovsky, Plainfield; Wei S. Hwang, Wayne; David J. Kamrath, Asbury, all of N.J.

[73] Assignee: The BOC Group, Inc., Montvale, N.J.

[21] Appl. No.: 28,413

[22] Filed: Mar. 20, 1987

[51] Int. Cl.[4] ..... F25S 3/02

[52] U.S. Cl. ..... 62/28; 62/22; 62/29; 62/31; 62/34; 62/40

[58] Field of Search ..... 62/9, 11, 22–24, 62/27–29, 31, 32, 40, 41, 42

[56] References Cited

U.S. PATENT DOCUMENTS

| | | | |
|---|---|---|---|
| 3,543,28 | 12/1970 | Crawford et al. | 62/41 X |
| 2,530,602 | 11/1950 | Dennis | 62/22 |
| 3,173,778 | 3/1965 | Gaumer, Jr. | 62/22 |
| 4,338,108 | 7/1982 | Isalski et al. | 62/22 |
| 4,496,382 | 1/1985 | Geist et al. | 62/40 X |
| 4,501,600 | 2/1985 | Pahade | 62/28 |
| 4,549,890 | 10/1985 | Bligh | 62/22 X |
| 4,629,484 | 12/1986 | Kister | 62/29 |

*Primary Examiner*—Steven E. Warner

*Attorney, Agent, or Firm*—R. Hain Swope; Chris P. Konkol; Larry R. Cassett

[57] ABSTRACT

There is disclosed an improved process for recovering argon from a tail gas stream, preferably a tail gas obtained from a hydrogen recovery unit processing a purge gas obtained in the synthesis of ammonia and comprised of argon, methane, nitrogen, and residual quantities of hydrogen, wherein the tail gas is partially liquefied prior to introduction into a first fractionation column to form a bottoms liquid stream comprised of argon and methane wherein such liquid stream is thereupon introduced into a second fractionation column to separate argon as an overhead gaseous stream which is condensed to form liquid argon or as product.

12 Claims, 1 Drawing Sheet

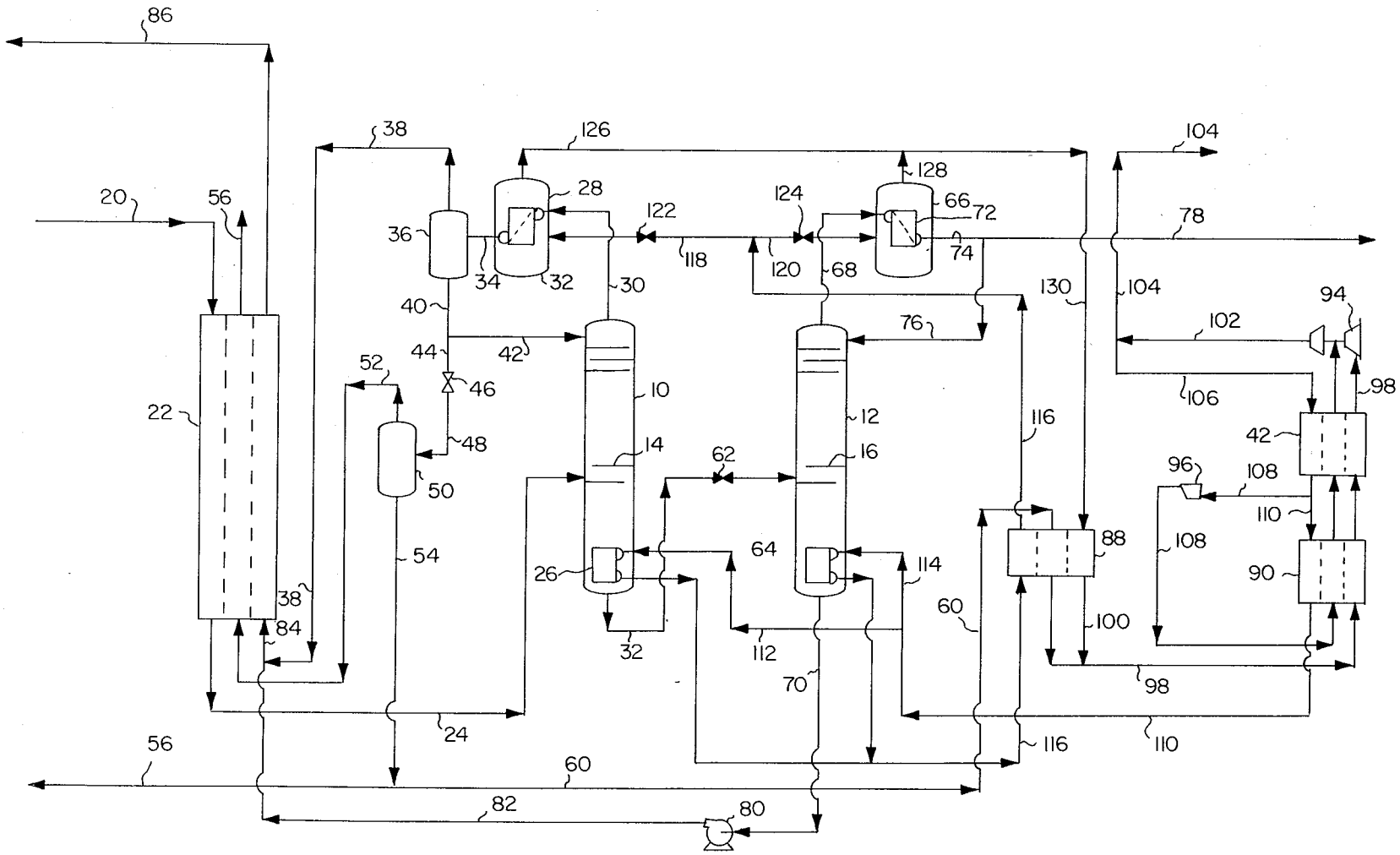
98
94
42
108
110
90
102
106
96
108
104
78
104
98
110
88
100
130
116
116
60
72
66
74
128
76
114
12
16
68
124
120
70
64
112
80
62
118
122
10
14
30
32
126
28
32
26
60
42
34
46
48
24
82
36
40
44
50
54
38
52
38
84
56
22
86
20
56

PROCESS FOR THE RECOVERY OF ARGON

BACKGROUND OF THE INVENTION (1) Field of the Invention

This invention relates to an improved process for recovering argon from gaseous streams, and more particularly to an improved process for recovering argon from a gaseous stream remaining after the recovery of hydrogen values from an ammonia synthesis gas.

(2) Description of the Prior Art

In U.S. Pat. No. 4,338,108 to Isalski et al., there is disclosed a process for recovery of argon from a gaseous stream remaining after the recovery of hydrogen from an ammonia synthesis gas. In accordance with such process, the tail gas is initially fractionated to provide a substantially hydrogen-free liquid stream comprised of argon, methane and nitrogen which is expanded into a first fractionation column to form an overhead gaseous stream including argon. The argon-nitrogen stream is thereupon introduced into a second fractionation column to form product argon withdrawn as liquid bottoms from the second fractionation column. Such process has excessive equipment requirements to provide for the separation of residual hydrogen as well as excessive power requirements per unit volume of liquid product argon.

OBJECTS OF THE INVENTION

An object of the present invention is to provide an improved process for recovering argon from a gaseous stream.

Another object of the present invention is to provide an improved process for recovering argon from a tail gas obtained from a hydrogen recovery unit processing purge gas from a process for synthesizing ammonia.

A further object of the present invention is to provide an improved process for recovering argon from a tail gas obtained from a hydrogen recovery unit processing purge gas from a process for synthesizing ammonia at significantly reduced energy cost per unit of product argon.

A still further object of the present invention is to provide an improved process for recovering argon from a tail gas obtained from a hydrogen recovery unit processing purge gas from a process for synthesizing ammonia permitting of improved argon recovery per unit volumes of feed.

Still another object of the present invention is to provide an improved process for recovering argon from a tail gas obtained from a hydrogen recovery unit processing purge gas from a process for synthesizing ammonia simultaneously producing liquid and gaseous nitrogen of highly purity.

Yet another object of the present invention is to provide an improved process for recovering argon from a tail gas obtained from a hydrogen recovery unit processing purge gas from a process for synthesizing ammonia and for providing pressurized fuel gas.

Still yet another object of the present invention is to provide an improved process for recovering argon from a tail gas obtained from a hydrogen recovery unit processing purge gas from a process for synthesizing ammonia wherein hydrogen and nitrogen are effectively separated from the feed stream in a single processing step.

SUMMARY OF THE INVENTION

These and other objects of the present invention are achieved in a process for recovering argon from a gaseous stream, preferably a tail gas obtained from a hydrogen recovery unit processing a purge gas obtained in the synthesis of ammonia and comprised of argon, methane, nitrogen, and residual quantities of hydrogen, wherein the tail gas is partially liquefied prior to introduction into a first fractionation column to form a bottoms liquid stream comprised of argon and methane wherein such liquid stream is thereupon introduced into a second fractionation column to separate argon as an overhead gaseous stream which is condensed to form liquid argon as product.

BRIEF DESCRIPTION OF THE DRAWING

A better understanding of the present invention as well as other objects and advantages thereof will become apparent upon consideration of the detailed disclosure thereof, especially when taken with the accompanying drawing of a schematic flow diagram of the process of the present invention.

DETAILED DESCRIPTION OF THE DRAWING

It is understood that certain equipment, such as valves and indicators and the like, have been omitted from the drawing to facilitate the description thereof and the placing of such equipment at appropriate places is deemed to be within the scope of one skilled in the art. Additionally, the process of the present invention will be described with reference to the recovery of argon from a tail gas stream remaining after removing hydrogen values from a purge gas following the synthesis of ammonia from hydrogen and nitrogen wherein the tail gas stream additionally includes methane and argon.

As understood by one skilled in the art, while the recycling of unreacted hydrogen and nitrogen to the ammonia synthesis reactor is desirable, inert gases, e.g. methane and argon, contained in the feed accumulate in the process and require removal to prevent excessive build-up to the detriment of ammonia processing requirements. Generally, after removal of residual ammonia and water vapor, the off-gas from ammonia synthesis typically has the following approximate compositions: hydrogen 61–58 mol %, nitrogen 15–23 mol %, methane 10–14 mol %, and argon 2–6 mol %. Thus, such off-gas contains 2–6 times the amount of argon than does air, and with the present demand for argon, presents a commercially viable source of argon.

Referring now to the drawing, there is illustrated the process of a preferred embodiment of the present invention, including a primary fractionation column 10 and a secondary fractionation column 12. The primary fractionation column 10 is provided with a plurality of contact trays, such as perforated plates, schematically illustrated as 14, which effect intimate contact between vapors rising in the column with liquid flowing down the column. The secondary fractionation column 12 is provided with perforated plates, schematically illustrated as 16 for effecting like contact between rising vapors and descending liquid streams.

In operation, the tail gas stream, at ambient temperature and a pressure of from 45 to 130 psia, is passed for cooling by line 20 in indirect heat transfer relationship through a heat exchanger 22 wherein a portion of the tail gas stream is condensed. A two-phase mixture of the tail gas stream is introduced via line 24 into an intermediate portion of the primary fractionation column 10 including a reboiler 26 and a reflux condenser assembly 28. The primary fractionation column 10 is operated to provide an overhead gaseous stream in line 30 comprising nitrogen and residual hydrogen and a bottoms liquid stream in line 32 comprising argon and methane.

The gaseous stream in line 30 is introduced into the reflux condenser assembly 28 including heat exchanger 33 and cooled to a temperature to condense a portion of such stream. The cooled, partially condensed stream is withdrawn by line 34 from the reflux condenser assembly 28 and introduced into a separator 36 to form a gaseous stream containing substantially all of the hydrogen and most of the nitrogen in the tail gas feed stream in line 38 and a liquid stream in line 40. A portion of the liquid stream in line 40 is returned by line 42 to an upper portion of the primary fractionation column 10 to provide reflux requirements therefor. The aqueous stream in line 38 is passed to the heat exchanger 22 to recover the cold potential.

The remaining portion of the liquid stream in line 40 (i.e. not required for reflux requirements) is passed by line 44 and expanded in valve 46 for introduction by line 48 into a separator 50 for separation into a gaseous stream in line 52 containing residual hydrogen dissolved in liquid nitrogen and a liquid stream in line 54. The gaseous stream in line 52 is passed to the heat exchanger 22 to recover its cold potential prior to venting to the atmosphere by line 56. The liquid stream in line 54 is passed by line 58 to a liquid nitrogen storage tank (not shown), or alternately, is passed by line 60 to the nitrogen heat pump cycle, as more fully hereinafter discussed.

The argon-enriched liquid stream in line 32 withdrawn from the primary fractionation column 10 is expanded by a valve 62 and is introduced into an intermediate portion of the secondary fractionation column 12 including a reboiler 64 and a reflux condenser assembly 66. The secondary fractionation column 12 is operated to provide an overhead gaseous argon stream in line 68 and a bottoms liquid methane stream in line 70. The gaseous argon stream in line 68 is introduced into the reflux condenser assembly 66 including heat exchanger 72 and cooled to a temperature to condense all or a major portion thereof withdrawn by line 74 from the reflux condenser assembly 66. A portion of the condensed stream in line 74 is returned by line 76 to the upper portion of the secondary fractionation column 12 to provide reflux requirements therefor with the remaining portion being passed by line 78 to argon storage facilities (not shown).

The liquid stream in line 70, substantially pure methane withdrawn as bottoms from the secondary fractionation column 12 is passed by pump 80 via line 82 and is combined in line 84 with the gaseous stream in line 38 passed through the heat exchanger 22 to recover its cold potential. The pressure of the liquid methane stream in line 70 is increased by pump 80 to about the operating pressure of the primary fractionation column 10 prior to combining with the hydrogen-nitrogen stream in line 38 to depress the boiling point of the methane allowing same to boil in the heat exchanger 22 against the incoming feed in line 20. The gaseous hydrogen-nitrogen methane is thereby warmed to ambient temperature in line 86 for use, such as a fuel gas or the like.

The energy requirements for fractionation, etc., to maintain cryogenic temperatures may be provided by any means; however, such energy requirements may be readily provided by a nitrogen heat pump cycle. As hereinabove discussed, the partially condensed stream in line 34 from the reflux condenser assembly 28 is separated in separator 36 into a gaseous stream in line 38 containing most of the nitrogen and substantially all of the hydrogen in the tail gas feed, and a liquid nitrogen-containing stream in line 40, a portion which in line 42 provides the reflux requirements for the primary fractionation column 10. Since the liquid nitrogen stream in line 40 still contains dissolved hydrogen, the liquid stream in line 44 is flashed across the valve 46 to cause substantially all of the remaining hydrogen to vaporize concomitantly with some nitrogen withdrawn as a gaseous stream in line 52 from separator 50 thereby permitting the withdrawal by line 54 of substantially pure nitrogen. Liquefied nitrogen in line 54 in excess of the nitrogen requirements in line 60 for the nitrogen heat pump cycle and for gaseous nitrogen product is passed by line 58 to the liquefied nitrogen storage facility, as hereinabove described.

The nitrogen heat pump cycle is comprised of indirect heat transfer exchangers 88, 90, and 92, cycle compressor 94, and expander unit 96. The liquid nitrogen in line 60 is vaporized and heated in indirect heat transfer exchanger 88 and combined in line 98 with a recycle gaseous nitrogen stream in line 100 prior to passage through indirect heat transfer exchangers 90 and 92. The gaseous stream in line 98 is compressed in the cycle compressor 94 to a pressure of from 275 to 400 psia to form a gaseous stream in line 102. A portion of the gaseous stream in line 102 in excess of heat pump requirements is passed at an appropriate stage pressure by line 104 to gaseous nitrogen user (not shown). The remaining portion in line 102 is passed by line 106 through indirect heat transfer exchanger 92 and a portion thereof in line 108 is passed through the expander unit 96. Such expanded portion in line 108 is thence passed through the indirect heat transfer exchangers 90 and 92 to be introduced at an intermediate pressure level into the cycle compressor 94 and admixed with the gaseous nitrogen in line 98 introduced into the cycle compressor 94 at a lower pressure level.

The remaining portion of the compressed nitrogen in line 106 is passed by line 110 through the indirect heat transfer exchanger 90 and is split into two gaseous nitrogen streams in lines 112 and 114. The gaseous nitrogen streams in lines 112 and 114 are introduced into the reboilers 26 and 64 of the primary fractionation column 10 and the secondary fractionation column 12, respectively, to provide the reboiler requirements therefor. The nitrogen gaseous streams in lines 112 and 114 are withdrawn from the reboilers 26 and 64, respectively, and combined in line 116 for passage through the indirect heat transfer exchanger 88. The nitrogen stream in line 116 is split into liquid nitrogen streams in lines 118 and 120 for introduction, after being expanded in valve 122 and 124, into the reflux condenser assemblies 28 and 66, respectively, to provide the cooling requirements, therefor. The resulting gaseous nitrogen streams from reflux condenser assemblies 28 and 66 in lines 126 and 128, respectively, are combined in line 130 to form, after passage through the indirect heat transfer exchanger 88, the recycled gaseous nitrogen stream in line 100.

Generally, about one-half of the flow of the gaseous nitrogen in line 106 is cooled in the sequence of the heat exchangers to a temperature near its dew point for condensation in the reboilers 26 and 64 of the primary and secondary fractionation columns 10 and 12, respectively. The liquefied nitrogen in line 116 is subcooled during passage through the indirect heat transfer exchanger 88 prior to being expanded by valves 122 and 124 into the reflux condenser assemblies 28 and 66, respectively, to be vaporized at 20 to 40 psia against the overhead gaseous streams in lines 30 and 68 from the primary and secondary fractionation columns 10 and 12, respectively. The thus vaporized nitrogen streams in lines 126 and 128 are combined in line 130 and warmed in the indirect heat transfer exchangers 88, 90, and 92 prior to being returned to the cycle compressor 94 at a lower pressure level together with the nitrogen stream in line 60.

EXAMPLE

The following example is illustrative of conditions for the process of the present invention, and it is to be understood that the scope of the invention is not to be limited thereby.

EXAMPLE I

An ammonia plant purge gas having been processed for the recovery of hydrogen, and which is free of ammonia and water, flows at a rate of 840 lb mol/hr and pressure of 49 psia. Such gaseous stream having the composition shown in Table I below is cooled from ambient temperature to a temperature of −271.5° F. in heat exchanger 22.

TABLE I

| Gas | Mole % |
|---|---|
| $N_2$ | 64.02 |
| $CH_4$ | 21.00 |
| $H_2$ | 10.18 |
| Ar | 4.80 |

Such thus cooled stream which emerges from the heat exchanger 22 as a vapor-liquid mixture is passed serially to the primary and secondary fractionation columns 10 and 12 wherein the bottoms product of the primary fractionation column 10 is introduced into the secondary fractionation column 12. The primary and secondary fractionation columns 10 and 12 are operated under the conditions shown in the following Table II, such that all of the the hydrogen and nitrogen contained in the feed gas stream in line 20 exits as overhead in line 30 from the primary fractionation column 10 and substantially all of the methane exits as bottoms in line 70 from the secondary fractionation column 12.

TABLE II

| | Pressure | Temperature |
|---|---|---|
| Fractionation Column (10) Overhead | 45.5 psia | −301.8° F. |
| Fractionation Column (10) Bottoms | 47.5 psia | −249.4° F. |
| Fractionation Column (12) Overhead | 19 psia | −297.5° F. |
| Fractionation Column (12) Bottoms | 21 psia | −250.1° F. |

Merchant grade argon product is withdrawn from the secondary fractionation column 12 as overhead vapor and is condensed in the reflux condenser assembly 66 and sent to storage (not shown) at a rate of 39.47 lb mol/hr. Liquid methane, withdrawn from the secondary fractionation column 12 as bottoms in line 70, is passed by pump 80 to heat exchanger 22 at a pressure of 45 psia and mixed with the hydrogen-nitrogen gaseous stream in line 38 with the combined stream in line 84 being vaporized and warmed to ambient temperature. The thus warmed gaseous stream in line 86 is withdrawn from the heat exchanger 22 and returned as fuel to the ammonia synthesis process.

The overhead vapor in line 30 from the primary fractionation column 10 is introduced into the reflux condenser assembly 28 for partial condensation thereof and is then introduced into the separator 36. The reflux condenser assembly 28 is operated to condense overhead vapor for reflux to the primary fractionation column 10 and to provide an impure liquid nitrogen stream to be further processed. The uncondensed overhead in line 38 separated in the separator 36 is passed to the heat exchanger 22 and is admixed with liquid methane in line 82 from the pump 80 which is then warmed to ambient temperature as hereinabove mentioned at a pressure of 42 psia for use as dry fuel gas.

Pure nitrogen product is produced from the impure liquid nitrogen in line 40 withdrawn from the separator 36 by flashing such gaseous stream into separator 50. The separator 50 is operated at a pressure between 20 to 30 psia so that hydrogen dissolved in the higher pressure impure nitrogen is released from solution and is passed to the heat exchanger 22 to be warmed to ambient temperature. Liquid nitrogen containing less than 100 parts per million of hydrogen is withdrawn from the separator 50 at a rate of 185.0 lb mol/hr. 14.9 mol/hr. of pure liquid nitrogen is passed to storage (not shown); the remaining 170.1 lb mol/hr. of pure liquid nitrogen is passed to the indirect heat transfer exchanger 88 to be vaporized and combined with nitrogen in line 100 for the nitrogen heat pump cycle. The pure nitrogen in line 98 is passed through indirect heat transfer exchangers 90 and 92 wherein it is warmed to ambient temperature and is made available at convenient pressures from the nitrogen cycle compressor 94 (e.g. 362 psia) which corresponds to the discharge pressure of the nitrogen cycle compressor 94.

Numerous modifications and variations of the present invention are possible in light of the above teachings and therefore, within the scope of the appended claims, the invention may be practiced otherwise than as particularly described.

What is claimed:

1. A process for producing substantially pure argon from a hydrogen recovery unit tail gas stream comprising argon, nitrogen, methane and residual amounts of hydrogen comprising:

a. introducing the tail gas stream into a first fractionation zone under conditions to separate a liquid stream comprising argon and methane and a gaseous stream comprising nitrogen and hydrogen;

b. introducing the liquid stream into a second fractionation zone under conditions to separate argon as a gaseous product stream and methane as a liquid stream;

c. partially condensing the gaseous stream formed in step (a) and introducing it into a first separation zone to form a gaseous stream containing substantially all of the hydrogen and a liquid stream containing nitrogen and dissolved hydrogen;

d. combining the liquid methane stream formed in step (b) with the gaseous hydrogen stream formed in step (c), and passing the combined stream through a heat exchanger to recover its cold potential;

e. expanding the liquid stream formed in step (c) and introducing it into a second separation zone to form a gaseous stream containing hydrogen and a liquid product nitrogen stream;

f. passing a portion of the liquid product nitrogen stream to a heat pump cycle to provide referigeration requirements for said first and second fractionation zones; and g. introducing a nitrogen stream withdrawn from said heat pump cycle into said first and second fractionation zones to provide the reboiling requirements therefor.

2. A process in accordance with claim 1, wherein said gaseous stream recovered from said separation zone is passed through a heat exchanger zone to recover its cold potential.

3. A process in accordance with claim 1, wherein said gaseous stream withdrawn from said second separation zone is passed through a heat exchanger to recover its cold potential.

4. A process in accordance with claim 1 wherein said tail gas stream is cooled prior to step (a).

5. A process in accordance with claims 1 or 4, wherein said tail gas stream is at a pressure of from 45 to 130 psia prior to introduction into said first fractionation zone.

6. A process in accordance with claims 1 or 4, wherein said product argon stream formed in step (b) is condensed for passage to product storage.

7. A process in accordance with claims 1 or 4, wherein the liquid stream formed in step (b) is passed through the heat transfer zone countercurrent to said tail gas stream.

8. A process in accordance with claim 1, wherein said liquid stream formed in step (b) is pressurized prior to being combined with the gaseous hydrogen stream formed in step (c).

9. A process in accordance with claim 8, wherein said liquid stream formed in step (b) is pressurized to about the operating pressure of said first fractionation zone before being combined with said gaseous hydrogen stream.

10. A process in accordance with claim 1, wherein nitrogen streams recovered from said first and second fractionation zones after providing said reboiling requirements therefor provide reflux requirements for said first and second fractionation zones.

11. A process in accordance with claim 10, wherein nitrogen streams removed from said first and second fractionation zones after providing said reboiling requirements therefor are combined, cooled and expanded prior to providing said reflux requirements for said first and second fractionation zones.

12. A process in accordance with claim 11, wherein nitrogen streams recovered from said first and second fractionation zones after providing reflux requirements therefor are returned to said notrogen heat pump cycle.

* * * * *